United States Patent [19]

Knopik

[11] 4,183,407

[45] Jan. 15, 1980

[54] EXHAUST SYSTEM AND PROCESS FOR REMOVING UNDERGROUND CONTAMINANT VAPORS

[76] Inventor: Duane L. Knopik, 1741 Yorkshire Ave., Saint Paul, Minn. 55116

[21] Appl. No.: 848,894

[22] Filed: Nov. 7, 1977

[51] Int. Cl.[2] ..... E21B 43/00

[52] U.S. Cl. ..... 166/314; 166/50

[58] Field of Search ..... 166/50, 314; 61/11, 61/13; 405/39-41, 129

[56] References Cited

U.S. PATENT DOCUMENTS

| | | | |
|---|---|---|---|
| 166,357 | 8/1875 | Gray | 166/50 |
| 2,375,865 | 5/1945 | Nebolsine | 166/50 |
| 2,385,298 | 9/1945 | Muskat | 166/314 X |
| 2,434,239 | 1/1948 | Zublin | 166/314 X |
| 2,508,949 | 5/1950 | Howard | 299/12 X |
| 2,518,292 | 8/1950 | De Anglis | 61/11 |
| 2,740,476 | 4/1956 | D'Audiffret et al. | 166/50 X |
| 3,261,401 | 7/1966 | Karr | 166/50 |
| 4,026,355 | 5/1977 | Johnson et al. | 166/314 X |

*Primary Examiner*—Ernest R. Purser
*Assistant Examiner*—Nick A. Nichols, Jr.
*Attorney, Agent, or Firm*—Richard Francis

[57] ABSTRACT

An exhaust system and process for removing contaminant vapors from contaminated underground areas is described. The exhaust system includes a conduit directed underground with a lower end extending to the area of contamination and an upper end opening above the ground surface, a plurality of elongate perforated collection elements in communication with and extending angularly from the lower end of the conduit for receiving said vapors from the contaminated ground, a manifold connecting the collection elements to the lower end of the conduit and an exhaust means disposed in the upper end of the conduit for drawing the vapors into the collection elements from the area of contamination through the conduit and expelling the same into the atmosphere or into a suitable collection device.

1 Claim, 3 Drawing Figures

EXHAUST SYSTEM AND PROCESS FOR REMOVING UNDERGROUND CONTAMINANT VAPORS

BACKGROUND OF THE INVENTION

1. Field of the Invention

The present invention relates to an exhaust system and process for removing contaminant vapors from contaminated underground areas.

2. Description of the Prior Art

Various techniques are known in the art for removing large deposits of underground contaminant liquid and vapor. Such contaminants include gasoline or other normally liquid volatile petroleum products which frequently escape from underground storage tanks because of the development of leaks in the tank walls or transfer lines or because of negligent handling of these substances, e.g., because of overfilling.

A particularly efficient device for removing liquid contaminants is described in my U.S. Pat. No. 3,980,318 entitled "Underground Fluid Recovery Device" which issued Sept. 14, 1976. The device described in my patent identified above provides for large scale recovery of liquid and vaporized underground contaminants (e.g., gasoline) from subterranean areas contaminated therewith and may be employed to remove substantially all of such contaminant liquid and vapor. However, use of the device described in my patent is relatively expensive in terms of manpower expended and equipment cost. The device therefore must be moved from location to location for optimum efficient commercial use, once substantially all liquid contaminant has been removed from the contaminated area, although small amounts of residual contaminant vapor may still remain. To remove this residual contaminant vapor from the underground contaminated area would require a considerably longer period of time for my large-scale recovery device to remain in continued use on a particular location and the amount of vapor that could be removed does not economically justify such long-term usage. Accordingly, there exists a need for a simpler, less expensive exhaust system that may be used as an auxiliary to my largescale recovery device for use at a location over a considerable period of time to remove substantially all traces of residual contaminant vapors from contaminated underground areas.

SUMMARY OF THE INVENTION

The present invention provides an exhaust system for removing residual contaminant vapors from contaminated underground areas. The device of my invention is formed of a plurality of angularly disposed perforated elongate collection elements positioned within the contaminated area, a manifold into which the collection elements are fitted, an exhaust means disposed at the ground surface for drawing the vapors into the collection elements, a conduit directed between the manifold and the exhaust means to carry the vapors to the atmosphere or to a suitable collection device.

The number, length and location with respect to each other of the elongate perforated collection elements is an important aspect of the invention. There should be at least two collection elements to provide effective recovery of contaminant vapors from the contaminated area. The preferred number of collection elements is from four to eight, although this may vary depending upon the area of contamination and upon the obstructions present in the contaminated areas. The smaller the area and the more obstructions, the fewer collection elements that will be used. The collection elements should be at least one foot long and preferably at least three feet long for effective removal of vapors from a large area of contamination. Typical lengths used for large areas of contamination range from four to ten feet. The collection elements should be angularly disposed with respect to one another for effective vapor recover. That is, they should not be substantially parallel but should be spaced apart at an angle, preferably of at least 20° and most preferably of at least 30°. The preferred arrangement of the elongate collection elements is in a radial array, although other configurations, e.g., fan or wing shapes may be equally useful and may actually be required to avoid ground obstructions.

Each collection element is characterized by having a wall which defines a closed-end tube which has one end open to a chamber. The wall should be a thickness which will not be crushed under the use conditions herein defined. The wall materials should be selected to make the collection elements crush-resistant and not easily deformable in the use conditions described. Elongate collection elements formed of metal such as iron or steel and rigid plastic are preferred.

The perforations in the elongate collection element walls should be large enough to permit vapor entry but not so large as to permit substantial soil entry. The size therefore will be dictated by the type of soil, smaller openings being required in fine sandy soil and larger openings being permitted in more cohesive soil such as clay. The openings will generally not exceed about ½ inch for most uses. The openings are preferably throughout the length of the collection element and most preferably uniformly spaced.

The angular spaced arrangement of the collection elements preferably extends throughout the area of contamination to draw residual contaminant vapors from the entire contaminated area. The area defined by the extremities of the collection element need not, however, be coextensive with the contaminated area since, once removal is started, the vapors have been found to travel a substantial distance through the soil to reach the collection element.

DESCRIPTION OF THE PREFERRED EMBODIMENTS

Figure 1:
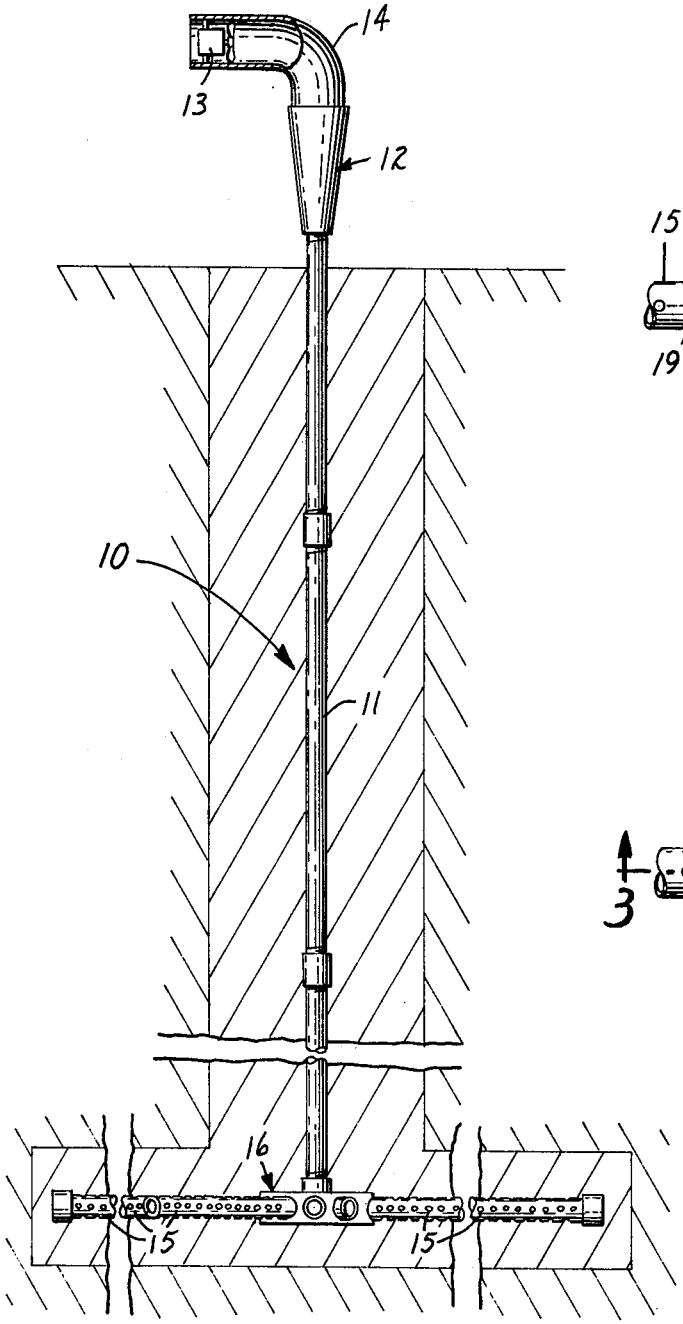
FIG. 1 is a partial cross sectional view in elevation of a preferred embodiment of the exhaust system of the present invention.
Figure 3:
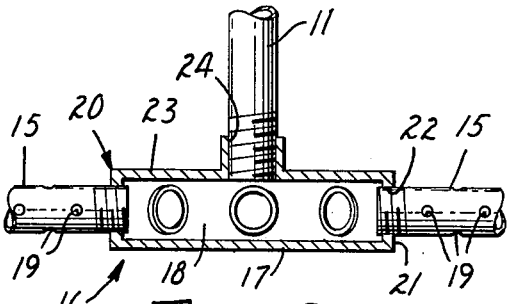
FIG. 3 is a side view partially in section at line 3—3 of the collection element portions depicted in FIG. 2.
Figure 2:
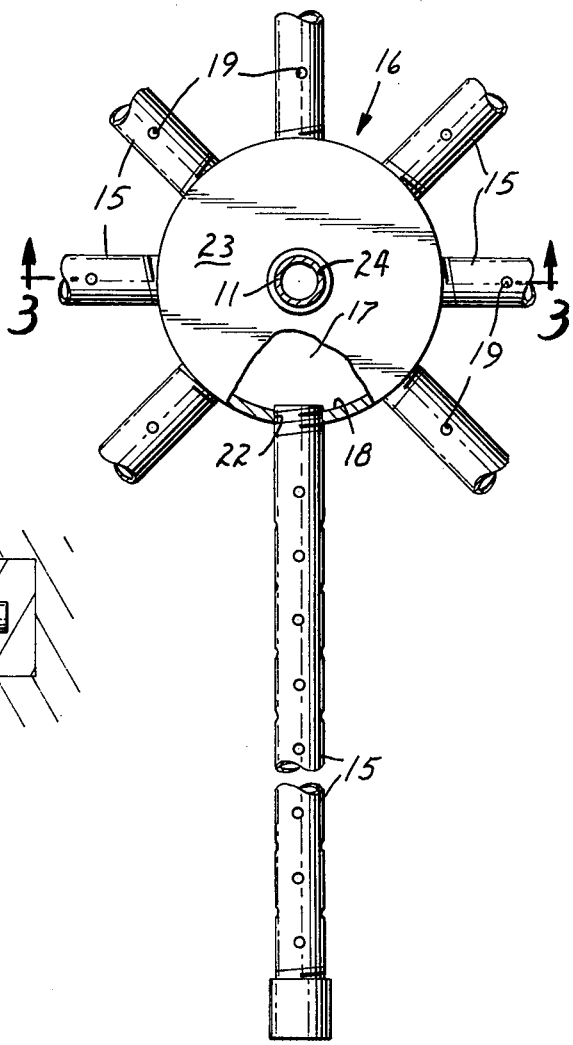
FIG. 2 is a plan view of the collection element portion of the device depicted in FIG. 1 with portions being cut away.

Referring now to the drawings and with specific reference first to FIG. 1, there is shown an exhaust system 10 that represents a preferred embodiment of my present invention that is particularly adapted for removing residual contaminant vapors from contaminated underground areas. The system 10 is formed of a pipe 11 (which may be as connected segments as shown) which provides a conduit that extends from the ground surface down to a point in or near the area of the contamination, an exhaust means 12 connected in fluid-tight relationship to the upper end of pipe 11 and having an exhaust device or fan 13 mounted in a suitable housing 14, angularly spaced closed-end perforated collection elements 15 that provide a radially disposed array 16 that extend radially outward from the lower end of pipe 11, and a manifold 20 having walls which define a collection chamber 18 into which is fitted in fluid-tight relationship the lower end of pipe 11 and the open ends of closed-end perforated collection elements 15 so that the chambers defined by the walls of perforated collection elements 15 are in communication with manifold chamber 18, the conduit provided by pipe 11 and exhaust means housing 14.

The exhaust device or fan 13 is sufficient to provide less than atmospheric pressure in the conduit and in the collection elements. Under such conditions vapor is drawn from the contaminated ground into the collection elements through the manifold and conduit to the surface of the ground where it may be collected in a suitable collection device or expelled into the atmosphere.

Standard steel pipe may be used in the system 10 to form the pipe 11. Useful pipes may have inner diameters from 1 to 8 inches, preferably from 2 to 6 inches. Perforatedcollection elements 15 may also be formed from standard steel pipe which can be perforated to provide a plurality of holes 19 through their side-walls to permit the passage of vapors therethrough in order that vapors may be drawn from the contaminated ground area along its entire length. The useful pipes forming the collection elements also have inner diameters from 1 to 8 inches, preferably from 2 to 6 inches. Commercially available perforated plastic drain tile may also be used to provide collection elements 15. Manifold 20 has a disc shaped base 17 with a circumferential wall 21 in which a number of inlets 22 are located and an upper wall 23 with an outlet 24. Inlets 22 and outlet 24 are adapted to respectively receive the open end portions of closed-end collection elements 15 and pipe 11 to serve as a connecting means therebetween.

To install exhaust system 10 in an operating location, it is necessary to excavate a portion of the ground down to a depth at which the assembled collection elements 15 and manifold 20 are to be located sufficient to accommodate a person or the assembled collection elements. If the excavation is not sufficiently large to accommodate the assembled collection elements 15, a person may easily enter the excavation and assemble the collection element array in situ. Closed-end perforated collection elements 15 may be urged into the ground, taking appropriate precautions not to plug holes 19, e.g., by forcing air through the pipes while urging the pipes in place. Alternatively, the excavation may be undercut at the bottom removing the soil to accommodate the collection elements. Once closed-end perforated collection elements 15 are in position, they are secured into inlets 22 of manifold 20 which is then connected to the lower end of pipe 11 by outlet 24. The excavated ground is then replaced as indicated in FIG. 1 and the exhaust means 12 is connected to the upper portion of the pipe 11.

The particular dimensions and operational requirements of the components of the system 10, except as heretofore set forth, are not critical so long as a cooperating combination of components is employed that will provide sufficient air and vapor exhaustion from the pipe 11 and the perforated collection elements 15 by exhaust means 12 such that contaminant vapor will be drawn through the walls of collection elements 15 and up through the pipe 11.

The following is exemplary of the dimensions of a particular system that can be employed for providing good vapor removal from the contaminated area in which it is installed. A conduit is provided by a pipe 12 feet long and 6 inches in inner diameter which was disposed in a vertical position to reach a collection element array composed of 8 perforated closed end pipes which were 8 feet long and 4 inches in inner diameter. An exhaust means comprising an exhaust fan having a 1/32 H.P. motor with a fan blade capable of removing air through the pipe 11 and collection element array 16 at the rate of 10 cubic feet per minute.

To provide sufficient air exhaustion, it is highly preferable that a pipe be employed as a conduit in the system. However, it is possible that the system can be employed without the use of a pipe as the conduit by merely employing the shaft of the excavation into the ground to serve as a conduit leading down to the angularly disposed collection elements. If this is done, manifold 17 may also be eliminated. However, when a shaft is employed as the conduit, it is preferable that the shaft be filled with a coarse granular material through which air may be easily drawn in order that the shaft will not collapse.

The time required to remove the contaminant vapor from the soil will depend upon the amount of contamination, the extent of contamination, the vapor pressure of the contaminant, the type of soil and the equipment used (e.g., the number of collection elements deployed and the size of the conduit and exhaust means). The time may vary from a few hours to many months or many years. The equipment should be designed for use at an installation for prolonged periods of time because that will be typical. For example, it will not be uncommon to operate the equipment continuously for many months.

While complete removal of the contaminant vapors may take a long period of time, the equipment has been found to provide dramatic rapid improvements in conditions typically encountered where such vapor contamination exists. For example, vapor contamination can be detected by smell and many contaminants have an extremely unpleasant smell and can even cause sickness such as nausea. It has been discovered that where such contamination exists in the ground adjacent a home so that the contaminate vapors permeate into the home, operation of the installed equipment for only a period of one hour has completely removed all detectable odors from the home. This is thought to be caused by the flow of vapor from the contaminated area being directed virtually exclusively into the collection elements and conduit by the action of the exhaust means.

What is claimed is:

1. A process for removing contaminant vapors from contaminated underground areas and comprising the following steps:

(1) excavating a shaft extending from the ground surface to a point within the contaminated area;

(2) positioning within said contaminated area a plurality of elongate perforated collection elements;

(3) connecting said elongate perforated collection elements to the lower end of a conduit having an upper end opening to the atmosphere, with the collection elements and conduit being angularly spaced from each other; and (4) exhausting air from the upper portion of said conduit to create less than atmospheric pressure in said conduit and in said collection elements whereby to draw contaminant vapors from the contaminated area into said collection elements and through said conduit to the ground surface.

* * * * *